US005606811A

United States Patent [19]

Jensen

[11] Patent Number: 5,606,811

[45] Date of Patent: Mar. 4, 1997

[54] DEVICE WITH SPREADER ROLLERS FOR INSERTING LAUNDRY ARTICLES INTO A FEEDER

[75] Inventor: Jørn M. Jensen, Bern, Switzerland

[73] Assignee: Ejnar Jensen & Søn A/S, Rønne, Denmark

[21] Appl. No.: 432,427

[22] Filed: Apr. 27, 1995

[30] Foreign Application Priority Data

Apr. 28, 1994 [DK] Denmark ..... 0491/94

[51] Int. Cl.[6] ..... D06F 67/04

[52] U.S. Cl. ..... 38/143

[58] Field of Search ..... 38/143; 162/270, 162/271; 271/234, 235, 245

[56] References Cited

U.S. PATENT DOCUMENTS

| | | | |
|---|---|---|---|
| 1,503,858 | 8/1924 | Steiner | 38/143 |
| 2,503,524 | 11/1950 | Stubblebing | 38/143 X |
| 3,228,127 | 1/1966 | Roilans | 38/143 |
| 3,414,997 | 12/1968 | Henry | 38/143 |
| 3,431,665 | 3/1969 | Weir | 38/143 |
| 3,735,512 | 5/1973 | Ross | 38/143 |
| 3,772,808 | 11/1973 | Behn | 38/143 |
| 5,416,992 | 5/1995 | Ueda et al. | 38/143 |

FOREIGN PATENT DOCUMENTS

| | | |
|---|---|---|
| 0419382A1 | 3/1991 | European Pat. Off. . |
| 0424290A1 | 4/1991 | European Pat. Off. . |
| 0609945A1 | 8/1994 | European Pat. Off. . |

*Primary Examiner*—Ismael Izaguirre

*Attorney, Agent, or Firm*—Finnegan, Henderson, Farabow, Garrett & Dunner

[57] ABSTRACT

A device for inserting substantially rectangular laundry articles into a feeder, comprising a conveyor which is adapted first to grip a stretched portion of a front edge on the laundry article and then to convey the laundry article into the feeder with the front edge foremost in the direction of feed, two spreader roller members and a device in front of the conveyor, seen in the direction of feed, to cause the laundry article to frictionally contact each of the spreader roller members in such a manner that the laundry article is guided to the right or to the left with respect to the direction of feed a suitable control system adapted for the purpose. The device for achieving frictional contact between the spreader roller members and the laundry article includes perforation in the surfaces of the spreader roller members and the generation of a negative pressure in the spreader roller members so that the laundry article is sucked into engagement with these. This ensures effective control and spreading of the laundry article during insertion into the feeder.

10 Claims, 5 Drawing Sheets

DEVICE WITH SPREADER ROLLERS FOR INSERTING LAUNDRY ARTICLES INTO A FEEDER

BACKGROUND OF THE INVENTION

The present invention concerns a device for inserting substantially rectangular laundry articles into a feeder.

Feeders are primarily used in big laundries in which they are used for smoothing and spreading large laundry articles, such as sheets, table-cloths, slips for eiderdowns, etc. for subsequent insertion of the laundry article into e.g. an ironing roller, it being important that these feeding devices spread and smooth the laundry articles effectively so that undesired creases will not occur after the ironing roller. The feeders frequently comprise a device for inserting laundry articles into the feeder of the type which is mentioned above. Most frequently, the laundry articles are inserted into the apparatus in that the laundry article is taken from a pile of laundry articles in a wrinkled state and optionally wet or damp. Then the laundry article is inserted into the machine by means of the insertion device mentioned above. Examples of prior art of this type are disclosed in e.g. EP Patent Application 424290 and EP Patent Application 419382 as well as in the applicant's Danish Patent Application 162/94. Although these known feeders provide the possibility of aligning laundry articles which are inserted askew into the feeder, this function may be made impossible, or at any rate difficult, if the laundry articles are positioned very askew in the feeder. This problem is remedied in practice in that the operator manually guides the laundry article during the insertion of it into the feeder so as to obviate the situation in which the laundry article is very askew. However, this takes up the operator's time, so that the operator cannot take a new laundry article from the above-mentioned pile and prepare it for insertion into the feeder until the first laundry article has been inserted completely into the feeder.

To automate this function, a device for inserting substantially rectangular laundry articles into a feeder is known, said device comprising a conveyor which is adapted first to grip a stretched portion of a front edge on the laundry article and then to convey the laundry article into the feeder with the front edge foremost in the direction of feed, two spreader roller members and means being provided in front of the conveyor, seen in the direction of feed, to cause the laundry article to frictionally contact each of the spreader roller members in such a manner that the laundry article is guided to the right or to the left with respect to the direction of feed by control means adapted for the purpose. A serious drawback of this known device is that the spreader roller members are caused to frictionally contact the laundry article by holding means that are provided opposite the spreader roller members so that the laundry article may be pressed against the spreader roller members by means of the holding means.

An object of the present invention is to provide a device for inserting substantially rectangular laundry articles into a feeder, wherein such holding means are rendered superfluous, thereby achieving a more inexpensive and simple structure and facilitating the manual insertion of the laundry articles into the insertion device.

SUMMARY OF THE INVENTION

This object is achieved by providing a device for inserting substantially rectangular laundry articles into a feeder, comprising a conveyor which is adapted first to grip a stretched portion of a front edge on the laundry article and then to convey the laundry article into the feeder with the front edge foremost in the direction of feed, two spreader roller members and means being provided in front of the conveyor, seen in the direction of feed, to cause the laundry article to frictionally contact each of the spreader roller members in such a manner that the laundry article is guided to the right or to the left with respect to the direction of feed by control means adapted for the purpose, characterized in that the means for achieving frictional contact between the spreader roller members and the laundry article includes perforations in the surfaces of the spreader roller members, and means for generating a negative pressure in the spreader roller members so that the laundry article is sucked into engagement with these.

Since the surfaces of the spreader roller members are perforated, and means are provided to generate a negative pressure in the spreader roller members the laundry article is sucked into engagement with these.

BRIEF DESCRIPTION OF THE DRAWINGS

An embodiment of the invention will be described more fully below with reference to the drawing, in which.

DETAILED DESCRIPTION OF THE INVENTION

Figure 1:
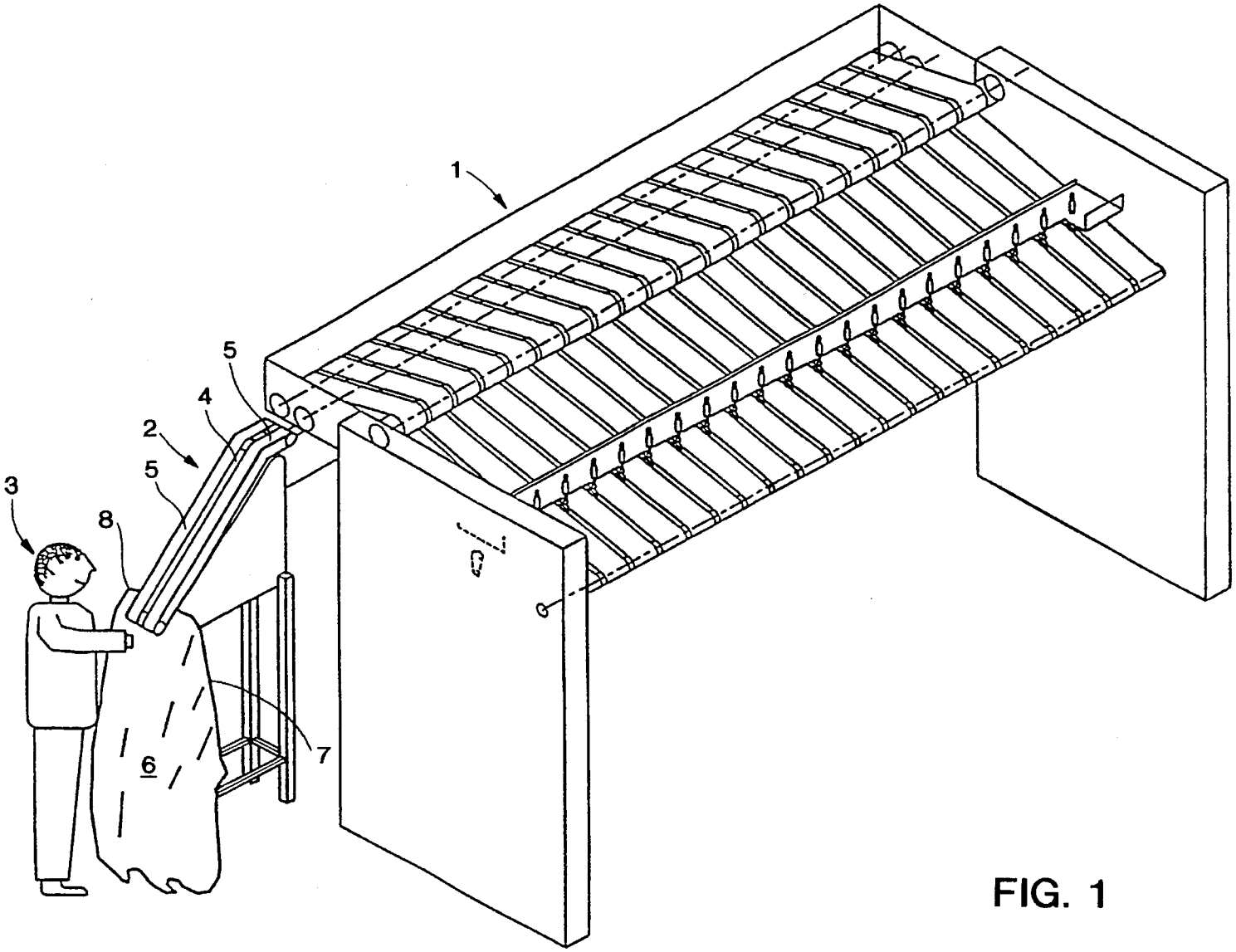
FIG. 1 is a pictorial view of a feeder.

FIG. 1 shows a feeder 1 with which an insertion device 2 is provided. The insertion device is manually operated by an operator 3, and it comprises a conveyor 4 which here has two juxtaposed conveyor belts 5. To operate the feeder 1 the operator inserts a laundry article 6 into the conveyor 4, which is activated to pull the laundry article 6 into the feeder 1. For reasons of productivity, this feeder 1 allows the laundry article 6 to be inserted into the conveyor 4 by stretching of a small portion of a front edge 7 at one corner 8 of the laundry article 6. The operator 3 can hereby insert the laundry article 6 into the feeder simply and quickly merely by finding a corner 8 on the laundry article 6.

The feeder 1 in FIG. 1 is shown without spreader rollers according to the invention, since FIG. 1 merely serves to illustrate the field of use of the invention. However, it will be seen from the figure that the laundry article 6 may be inserted askew into the feeder 1, if the operator 3 does not guide one side edge of the laundry article 6 during the insertion into the feeder 1. This risk is particularly great in connection with the feeder of the type which is shown in FIG. 1, since a large part of the laundry article 6 hangs down on one side of the insertion device 2 because it is inserted at a corner 8 into the device 2.

The actual feeder 1 will not be described more fully in this context, since the present invention may applied to feeders of different structures.

Figure 2:
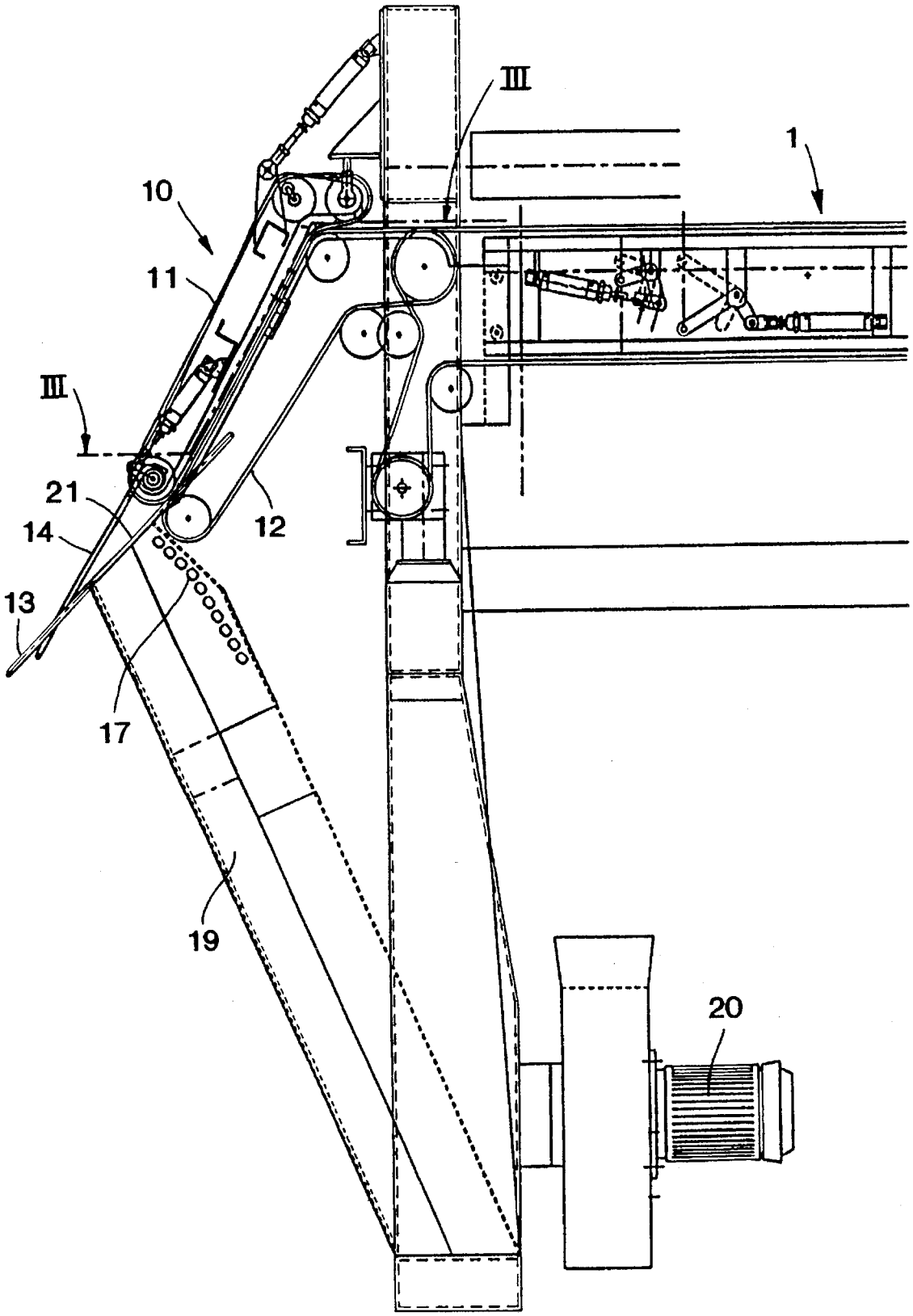
FIG. 2 is a lateral sectional view of part of the feeder of FIG. 1 with an insertion device according to the invention.
Figure 3:
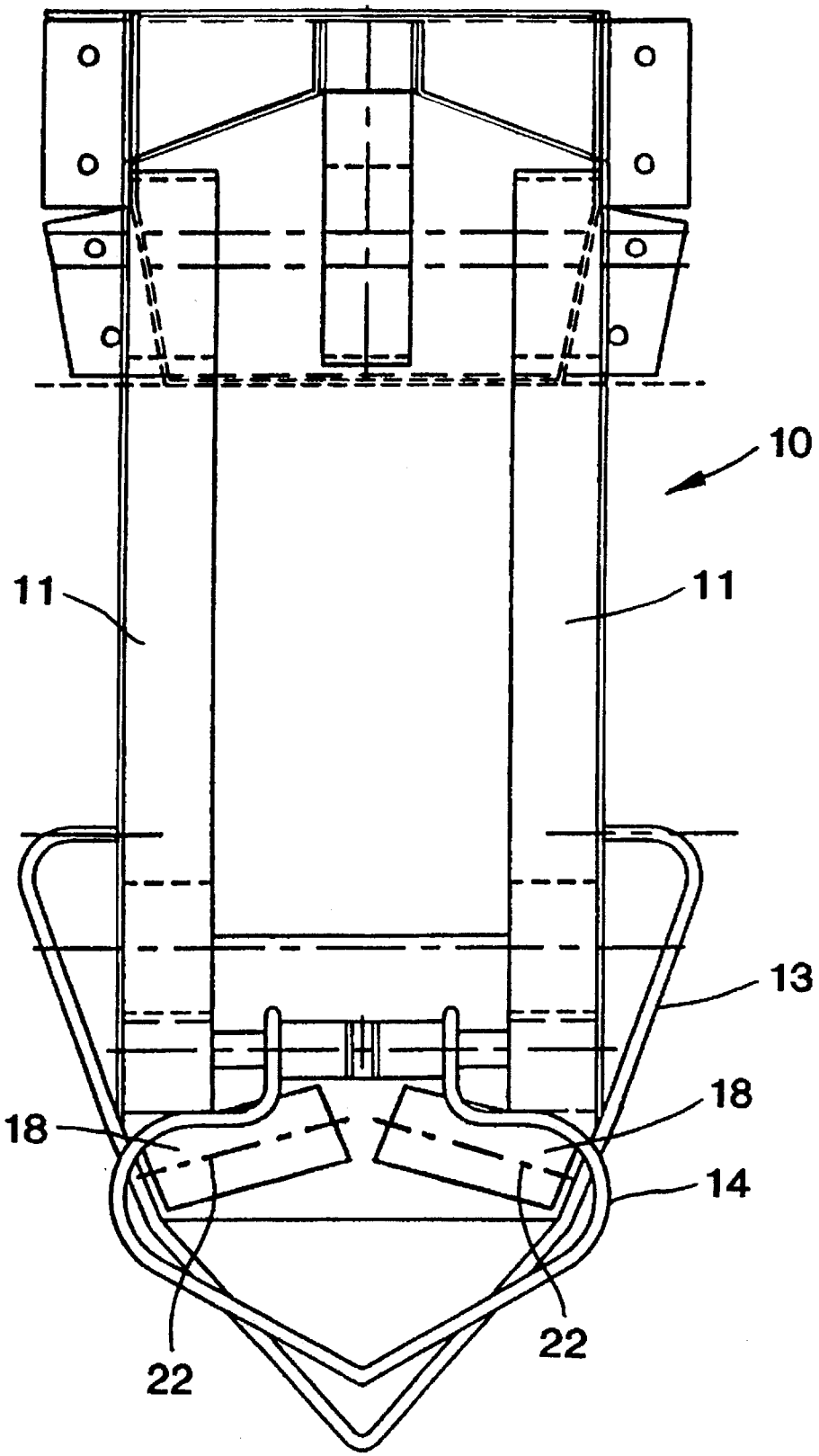
FIG. 3 is a sectional view of the insertion device taken along the line III—III in FIG. 2.

However, FIG. 2 and FIG. 3 show part of the feeder 1 of FIG. 1 with an insertion device 10 according to the invention. FIG. 3 is a sectional view along the line III—III in FIG. 2.

The insertion device 10 comprises a conveyor consisting of two juxtaposed, overlying conveyor belts 11. These conveyor belts 11 engage two underlying conveyor belts 12. The laundry article (not shown) may then be inserted between the overlying and the underlying conveyor belts 11 and 12, as appears from FIG. 1, following which the conveyor belts 11 and 12 are activated to pull the laundry article (not shown) into the feeder 1.

In an expedient embodiment of the invention as shown in FIGS. 2 and 3 a spreader horn arrangement is provided at the outer end of the conveyor belts, said spreader horn arrangement comprising an underlying horn 13 and an overlying horn 14 which are so positioned with respect to each other that a laundry article may be pulled between the underlying horn 13 and the overlying horn 14. As best shown in FIG. 3, the laundry article is then moved across a pair of perforated spreader rollers 18 positioned generally laterally of each other and in front of the conveyor belts 11 and 12 with respect to the direction of feed and into the conveyor belts 11 and 12 of the insertion device 10. The article thereby engages both horns 13 and 14 and the spreader rollers 18, following which the conveyor belts are activated so that the laundry article sweeps the horns 13 and 14 as well as the spreader rollers 18 over its entire length. The spreader horns may be of widely different shapes and be made of widely different materials.

When the laundry articles to be inserted are wrinkled and creased, these wrinkles and creases may cause the effect of the spreader roller members to be reduced. These spreader horns arranged in front of the spreader roller members eliminate or remove the creases and wrinkles of the laundry article, thereby improving the function of the spreader roller members.

As will be seen in FIG. 2, the insertion device 10 includes a suction box 19 in which vacuum is generated by means of a suction blower 20. At its upper end the suction box 19 has a plane face 21 in which the two perforated cylindrical spreader rollers 18 are provided, as shown in FIG. 3, so that part of the spreader rollers 18 protrudes through the plane face 21 on the suction box. A laundry article which is present across the spreader rollers 18 and is pulled past these spreader rollers 18, will thus be spread in the area present between the spreader rollers 18, since the spreader rollers 18 rotate about their respective axes 22 at an oblique angle with respect to the direction of the feed and because of the friction between the laundry article and the spreader rollers 18.

When the perforated spreader roller members are positioned in a suction chamber, a simple and safe structure is achieved, making it possible to apply a negative pressure to the spreader roller members.

In addition, the spreader rollers 18 enable automatic control of the straight insertion of the laundry articles into the feeder 1, since the spreader rollers 18 make it possible to cause the laundry articles to perform a lateral movement either to the right or to the left with respect to the direction of feed of the laundry article in the insertion device 10. Of course, this requires that the position of the laundry article can be registered, and that a control means or system can generate control signals with a view to achieving lateral movement of the laundry article.

Thus, the embodiment shown in FIG. 2 has a row of optical sensors 17 on one side of the suction box 19, said sensors being adapted to register how far one edge of the laundry article extends downwards with respect to the conveyors 11 and 12.

In response to signals from the optical sensors 17 control signals may then be generated in a known manner with a view to aligning the laundry article.

Alignment of the laundry article may be achieved in many ways according to the invention, it being possible to adapt the control system such that alignment is achieved by adjusting the angle of the spreader rollers with respect to the travelling direction of the laundry article, it being evident to a skilled person to teach expedient control systems for such alternative systems.

Figure 4:
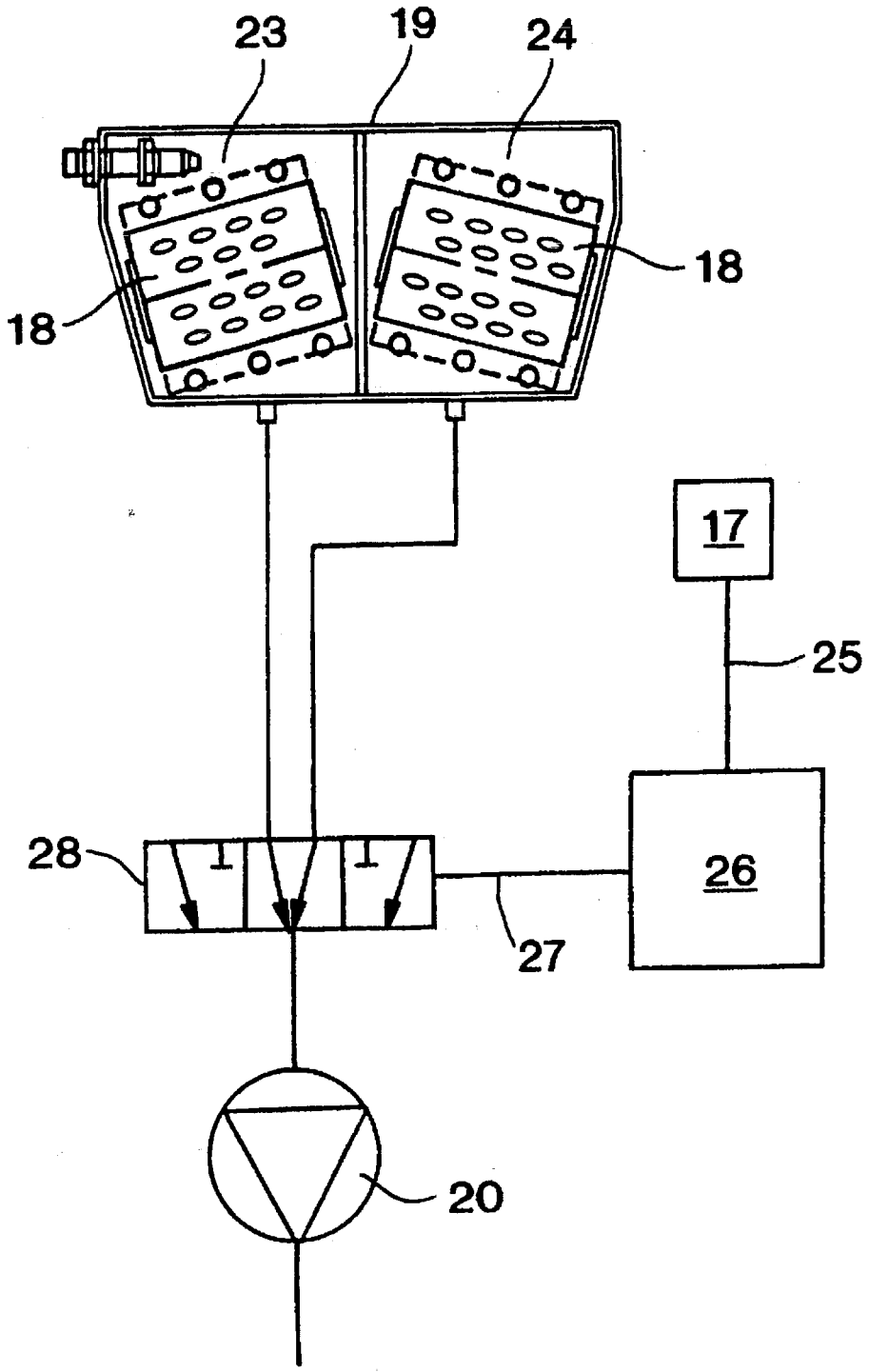
FIG. 4 is a schematic view of an embodiment of a control system according to the invention.
Figure 5:
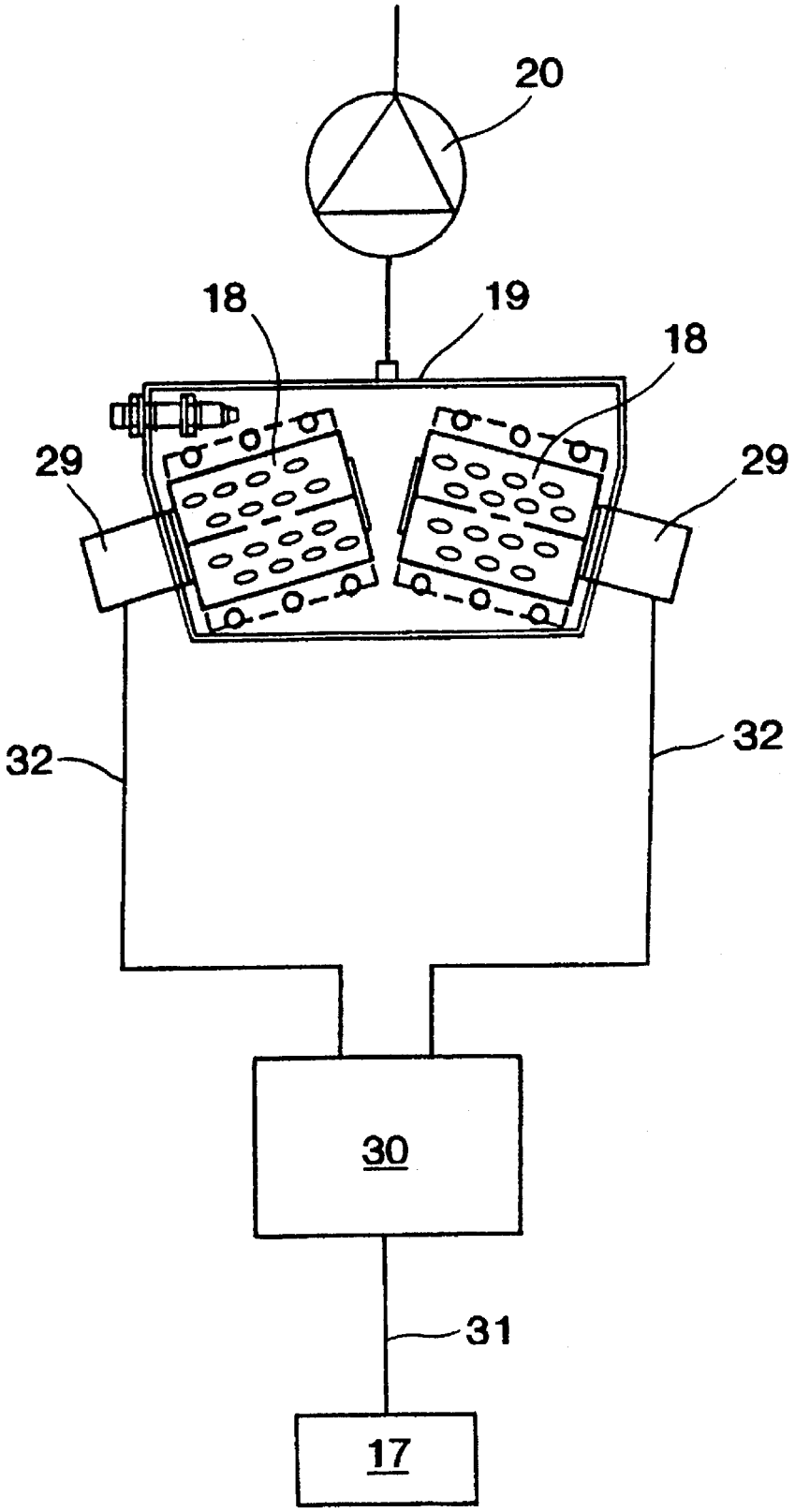
FIG. 5 is a schematic view of an alternative embodiment of a control system according to the invention.

However, FIGS. 4 and 5 show two preferred embodiments of the invention which are unique in that they are extremely simple and thus of inexpensive structure, while providing certain alignment of the laundry article.

FIG. 4 shows an embodiment in which the suction box 19 is divided into two separate compartments 23 and 24 for each of the spreader rollers 18. In response to signals 25 from a sensors 17 to the control unit 26, the control unit 26 generates signals 27 for controlling a valve 28, which has three positions where a negative pressure is applied by means of the suction blower 20 either to one of the spreader rollers or to both. The valve 28 is shown in FIG. 4 in the position in which a negative pressure is applied to both spreader rollers 18. When a negative pressure is applied to just one of the spreader rollers, this causes the laundry article to be moved laterally toward the spreader roller to which a negative pressure is applied, when the laundry article is pulled into the feeder.

Thus control means are adapted to selectively apply a negative pressure to each of the spreader roller members, thereby making it possible to guide the laundry article laterally during insertion into the feeder in a simple manner.

FIG. 5 shows an alternative embodiment in which a brake 29 is provided for each of the spreader rollers, and in which a control unit 30 generates signals 32 to brake one of the spreader rollers in response to signals 31 from the sensors 17, thereby aligning the laundry article which is pulled into the feeder. A constant negative pressure is applied to both spreader rollers here. The laundry article thus moves laterally with respect to the direction of feed away from the spreader roller which is braked.

Transverse displacement of the laundry article with respect to the travelling direction is thus achieved by braking the laundry article at the area around the braked spreader roller member, so that the laundry article can very quickly be moved toward the other spreader roller member because of the pull of the conveyor on the laundry article.

Preferably, the control units 26 and 30 terminate the negative pressure applied to the perforated spreader roller members when a laundry article is not present in the conveyor.

It is clear that the present invention may be embodied in many alternative embodiments; thus, the spreader rollers may be formed by e.g. perforated conveyor belts and the like by means of which the same effect can be achieved. In addition the angle between the spreader rollers may be adapted to the actual situation. An alternative solution is to provide a negative pressure directly in hollow spreader rollers so that the suction box is obviated. The reason is that the basic idea of the invention is achievement of friction between the laundry article and the spreader rollers.

I claim:

1. A device for inserting substantially rectangular laundry articles into a feeder, comprising a conveyor adapted to grip a stretched portion of a front edge of the laundry article and then convey the laundry article into a feeder with the front edge foremost in the direction of feed, at least two spreader roller members having perforated surfaces positioned generally laterally of each other and in front of the conveyor with respect to the direction of feed, means for generating a negative pressure in the perforated spreader roller members so that a laundry article is sucked into frictional engagement with the rollers and control means for selectively controlling said roller members in such a manner that the laundry article can be moved to the right or to the left with respect to the direction of feed as the article is pulled into the feeder by the conveyor.

2. The device of claim 1, wherein the control means selectively applies a negative pressure to each of the spreader roller members.

3. The device of claim 1, wherein each of the spreader roller members is provided with a brake device, and the control means selectively controls the brake devices to selectively brake each of the spreader roller members.

4. The device of claim 1, wherein the control means includes one or more sensors adapted to register the distance a side edge of the laundry article is from the conveyor.

5. The device of claim 4, wherein the sensors comprise a row of sensors positioned at mutually different distances from the conveyor.

6. The device of claim 1, wherein the control means terminates the negative pressure in the perforated spreader roller members when a laundry article is not present in the conveyor.

7. The device of claim 1, wherein the spreader roller members are rotationally symmetrical members that rotate about axes that extend at a similar and oblique angle from the direction of feed.

8. The device of claim 1, wherein the perforated spreader roller members are positioned in a suction chamber with just a part of the surface of the spreader roller members which is to contact the laundry article protruding through an opening in a top of the suction chamber, the means for generating a negative pressure creating a suction in said chamber.

9. The device of claim 1, including at least one spreader horn arranged in front of the spreader roller members with respect to the direction of feed for removing creases from the laundry article.

10. The device of claim 9, including an underlying horn and an overlying horn, said horns being positioned with respect to the conveyor and each other such that the laundry article during insertion is pulled by the conveyor between said horns and then across said rollers.

* * * * *